US007675481B2

(12) United States Patent
Konrad et al.

(10) Patent No.: US 7,675,481 B2
(45) Date of Patent: Mar. 9, 2010

(54) DEVICE FOR REPRESENTING AND/OR DISPLAYING VARIOUS PROCESS AND/OR CONTROLLED VARIABLES

(75) Inventors: Michael Konrad, Pfronten (DE); Georg Wolf, Markstoberdorf (DE)

(73) Assignee: Endress + Hauser Wetzer GmbH + Co., KG, Nesselwang (DE)

( * ) Notice: Subject to any disclaimer, the term of this patent is extended or adjusted under 35 U.S.C. 154(b) by 246 days.

(21) Appl. No.: 11/660,270

(22) PCT Filed: Jun. 22, 2005

(86) PCT No.: PCT/EP2005/052900

§ 371 (c)(1),
(2), (4) Date: Jul. 23, 2007

(87) PCT Pub. No.: WO2006/018342

PCT Pub. Date: Feb. 23, 2006

(65) Prior Publication Data

US 2008/0024498 A1 Jan. 31, 2008

(30) Foreign Application Priority Data

Aug. 16, 2004 (DE) ..... 10 2004 039 794

(51) Int. Cl.
*G09G 3/04* (2006.01)

(52) U.S. Cl. ..... 345/40; 345/35; 345/440.2

(58) Field of Classification Search ..... 345/35, 345/40, 440.2; 715/215
See application file for complete search history.

(56) References Cited

U.S. PATENT DOCUMENTS

| | | | | |
|---|---|---|---|---|
| 5,550,537 | A * | 8/1996 | Perdue | 340/870.01 |
| 5,815,072 | A * | 9/1998 | Yamanaka et al. | 340/461 |
| 5,844,558 | A * | 12/1998 | Kumar et al. | 345/440.2 |
| 5,884,577 | A | 3/1999 | Tanaka | |
| 5,949,346 | A * | 9/1999 | Suzuki et al. | 340/815.45 |
| 6,307,527 | B1 | 10/2001 | Youngquist | |
| 6,625,562 | B2 * | 9/2003 | Hayashi et al. | 702/145 |
| 7,010,366 | B2 * | 3/2006 | Konrad et al. | 700/83 |
| 2001/0022564 | A1 | 9/2001 | Youngquist | |
| 2003/0222867 | A1 * | 12/2003 | Bean et al. | 345/211 |

FOREIGN PATENT DOCUMENTS

| | | |
|---|---|---|
| DE | 299 03 215 U1 | 10/1999 |
| GB | 2108746 A | 5/1983 |
| WO | WO 99/02987 | 1/1999 |

* cited by examiner

*Primary Examiner*—Xiao M Wu
*Assistant Examiner*—Charles Tseng
(74) *Attorney, Agent, or Firm*—Bacon & Thomas, PLLC

(57) ABSTRACT

A device for representing and/or displaying various process and/or controlled variables for selectable application cases on a display unit, with bar graphs being arranged in respective, predetermined surface elements (A, B, C), with each bar graph, respectively each surface element (A, B, C), having a defined form and/or a defined position on the display. A control unit assembles bar graphs, respectively corresponding surface elements (A, B, C), mosaic-like in a display in such a manner that the resulting bar graph display is matched to a selected application case.

7 Claims, 2 Drawing Sheets

DEVICE FOR REPRESENTING AND/OR DISPLAYING VARIOUS PROCESS AND/OR CONTROLLED VARIABLES

TECHNICAL FIELD

The invention relates to a device for representing and/or displaying various process and/or controlled variables for selectable application cases on a display unit.

BACKGROUND DISCUSSION

For ascertaining or monitoring a physical or chemical process variable, the most varied types of sensors are used, which can function on the basis of very different physical principles of measurement. Thus, for example, the fill level of a fill substance in a container can be measured via the travel time of ultrasonic waves or electromagnetic waves, especially microwaves, which are reflected on the surface of the fill substance. In the case of microwaves, these are either radiated freely into the container in the direction of the surface of the fill substance, or they are guided along a conductive element into the container.

Beyond this, capacitive and radiometric measuring methods are used for fill level measurement. For limit level detection, preferably the resonance frequency of an oscillatory rod or an oscillatory structure made of a plurality of oscillatory rods is evaluated. In this method of measurement, one evaluates resonance frequency changes based on transitions between when the oscillatory rods are executing their oscillations freely and when such is occurring under contact with the fill substance.

Other process and controlled variables ascertained and monitored in process automation and measurements technology are, for example, temperature, pressure, ion-concentration, conductivity and flow, e.g. flow rate, of a medium through a pipeline. Of great importance in this connection are display or registering devices (display units), on which information won in the measurement is displayed, so that, at any time, the current state of a monitored process is available for operating personnel. Measuring devices and display devices of the above-described kind are sold by the Endress+Hauser Group in a multitude of variants optimally adapted to given processes.

The representation on the display of a display/registration device (display unit) should, of course, be matched as optimally as possible to the particular application; it is desirable, in this respect, that a quick glance at the display of the display unit can already deliver a clear indication what is happening in the particular application. For example, a process can be designed such that a tendential increase, or rise, of a measured variable is to be expected, such as would be the case e.g. in the filling of a container. The opposite situation arises in the emptying of a container, e.g. in a so-called "well application". Different again is the case involving control of a process variable to a predetermined setpoint—here, mainly the deviation of the currently measured process variable from the predetermined setpoint is of interest. It would thus appear to lie in the nature of the matter that, for these different applications, the suitable display equipment would likewise need to be designed differently.

SUMMARY OF THE INVENTION

An object of the invention is to provide a device universally applicable for different applications for representing and/or displaying various process and/or controlled variables on a display unit.

The object is achieved by features as follows: In each case, a bar graph is arranged in a predetermined surface, or areal, element; each bar graph, respectively each surface, or areal, element, has a defined form and/or a defined position in the display; and a control unit assembles the bar graphs, respectively the corresponding surface elements, mosaic-like in the display, in such a manner that the resulting bar graph display is matched to a selected application case. In other words, the device of the invention is a multifunctional bar-graph display, wherein, by control and suitable assembly of few selected bar graphs/surface elements, the presentation on the display is optimally adaptable and tunable to various applications. Preferably, the display unit of the invention is integrated into a field device. On the basis of the invention, it is possible always to use the same display unit, despite the most varied of process variables, which must be measured or monitored.

In an advantageous further development of the device of the invention, an input unit is provided, via which the particular bar graph display for a selected case of application is determinable.

A preferred embodiment provides that a first bar graph, respectively a first surface element, has a predetermined length and a predetermined height, with the height of the first bar graph, respectively the first surface element, differing in its middle region from the height of the first bar graph, respectively of the first surface element, in two lateral, end regions, and with the first bar graph, respectively the first surface element, being symmetric about its perpendicular bisector. Preferably, the first bar graph, respectively the first surface element, has a maximum height at the location of the perpendicular bisector, while the height in the two lateral, end regions is minimum.

In a favorable, further development of the device of the invention, a second bar graph, respectively a second surface element, and a third bar graph, respectively a third surface element, have, in each case, the form of an acute-angled, isosceles triangle, with the two peaks of the isosceles triangles adjoining one another in the region of the maximum height of the first bar graph, respectively, first surface element, and with the bases of the two isosceles triangles lying, in each case, in the two end regions of the first bar graph, respectively first surface element, parallel to the perpendicular bisector.

Advantageously, beyond this, it is provided that, by a combination of the first bar graph and the second bar graph, respectively of the first surface element and the second surface element, a bar graph rising from the left region of the display to the right region of the display is formed. With this arrangement, it is possible to display, optically on the display, process variables in a tendentially rising, respectively positive, standard application. Examples of this are the fill level of a fill substance in a silo or tank, or the temperature of a medium.

The opposite case, thus a tendentially decreasing, respectively negative, standard application, can be achieved by a combination of the first bar graph and the third bar graph, respectively the first surface element and the third surface element. By this combination, a bar graph rising from the right region of the display to the left region of the display is formed. A typical example for the application of this embodiment is a well application.

In an advantageous further development of the device of the invention, it is provided that, by a combination of the first bar graph, the second bar graph and the third bar graph, respectively the first surface element, the second surface element and the third surface element, a bar graph is formed, which rises from the middle of the first surface element to the left region and to the right region. A typical application case for this embodiment would be for a controller. This particular bar graph is best suited for displaying the controlled variable, which the controller is monitoring. The setpoint of the controlled variable lies, in the ideal case, at the perpendicular bisector, while the individual display segments (bars) of the bar graph in the regions lateral to the perpendicular bisector visualize the actual value, and, thus, the deviation of the controlled variable from the setpoint.

For signaling the sub-, respectively exceeding, of a limit, i.e. falling beneath, respectively exceeding, a limit value, an advantageous further development of the device of the invention provides arrow-shaped markings in the end regions of the individual bar graphs, respectively individual surface elements. Also these markings are composed, preferably, of two segments. The transitional region important for NAMUR can be visualized by the display segment lying between an end region of the bar graph, respectively surface element, and the tip of the arrow. In such case, the display segment forming the actual arrow tip represents the error case.

Beyond this, in an advantageous further development of the device of the invention, at least one region is provided on the display for showing alphanumeric characters and/or symbols. If, for example, fill level is presented on the display, then, in parallel, in the region provided for alphanumeric characters, the corresponding measured value can be given numerically in suitable units of length.

BRIEF DESCRIPTION OF THE DRAWINGS

The invention will now be explained in further detail on the basis of the appended drawings, the figures of which show as follows.

DETAILED DESCRIPTION OF THE DRAWINGS

Figure 1:
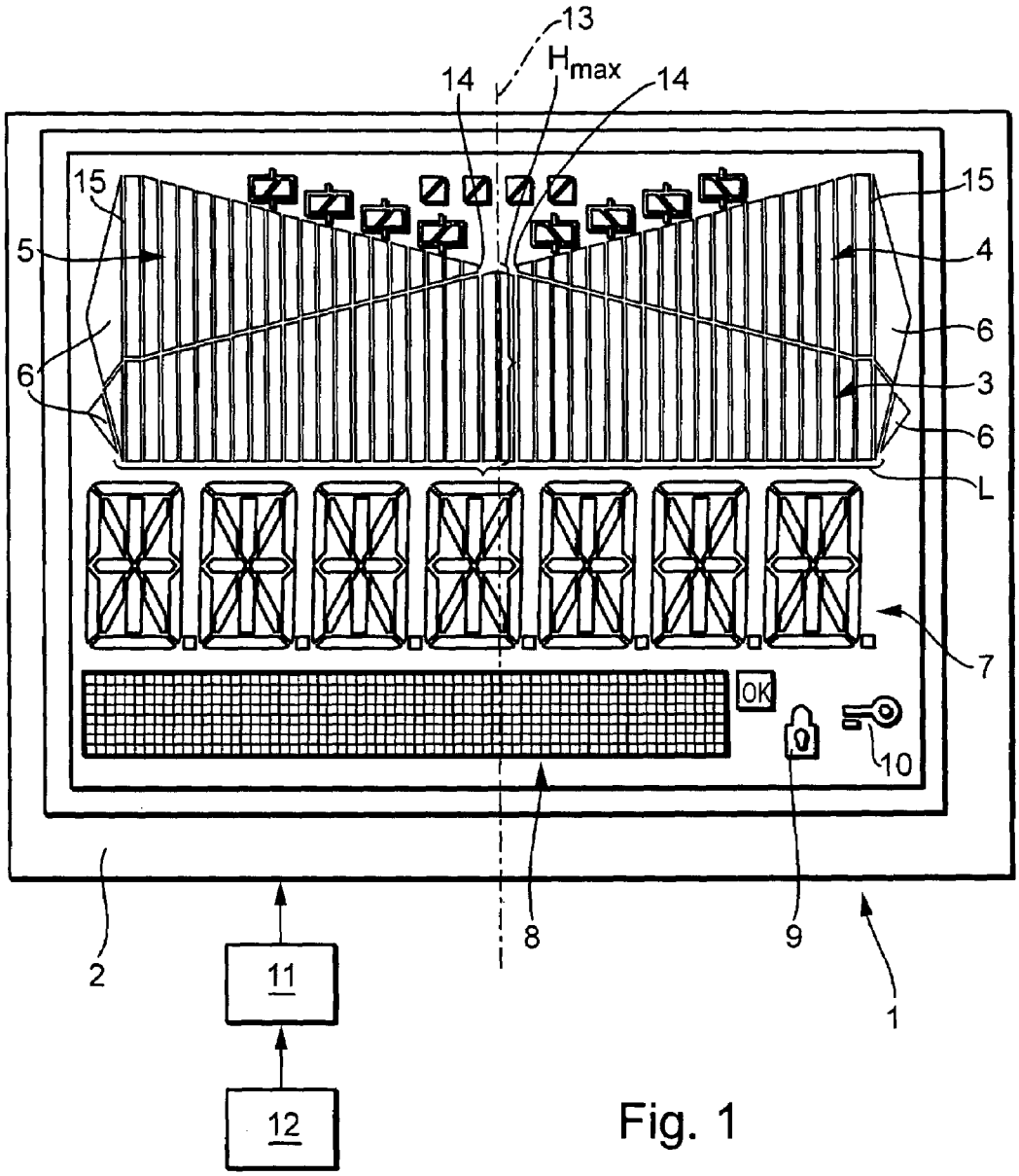
FIG. 1 a view of a preferred form of embodiment of the device of the invention.

FIG. 1 is a view of a preferred form of embodiment of the device 1 of the invention. The device 1 of the invention is composed of a display unit 2 a control unit 11 and an input unit 12. Of course, the input unit 12 can, just as well, be an integral component of the device 1 of the invention.

An essential component of the invention is the bar-graph display. Each bar graph 3, 4, 5 is composed of a number of display segments extending parallel to the perpendicular bisector of the first bar graph 3. The display segments are arranged within defined surface elements A, B, C. The bar-graph display is composed, in the illustrated case, of three bar graphs 3, 4, 5, which define the respective surface elements A, B, C. The first bar graph 3, respectively the first surface element A, has a predetermined length L and a predetermined height H, with the height Hm of the first bar graph 3, respectively the first surface element A, differing in the middle region from the height Hs of the first bar graph 3, respectively the first surface element A, in the two lateral, end regions. The first bar graph 3, respectively the first surface element A, is symmetrical about the perpendicular bisector. Preferably, the first bar graph 3, respectively the first surface element A, has a maximum height Hmax in the region of the perpendicular bisector 13, while the height Hs in the two lateral, end regions is minimum.

The second bar graph 4, respectively the second surface element B, and the third bar graph 5, respectively the third surface element C, have, in each case, the form of an acute-angled, isosceles triangle, with the two peaks 14 of the isosceles triangles B, C adjoining the region of maximum height Hmax of the first bar graph 3, respectively the first surface element A, and with the bases 15 of the two isosceles triangles B, C lying, in each case, parallel to the perpendicular bisector 15 in the two end regions of the first bar graph 3, respectively the first surface element A.

Figure 2A:
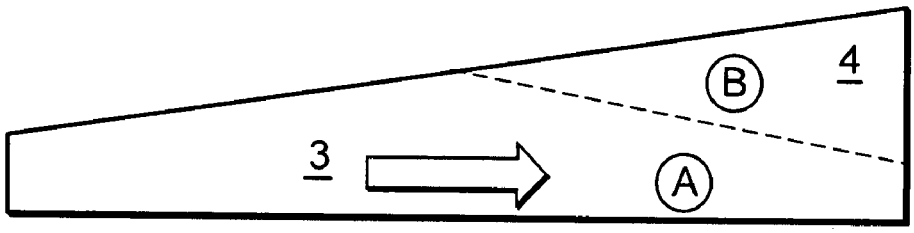
FIG. 2*a* a schematic representation of an arrangement of the bar graphs for visualizing a process variable in a process with tendential increase.
Figure 2B:
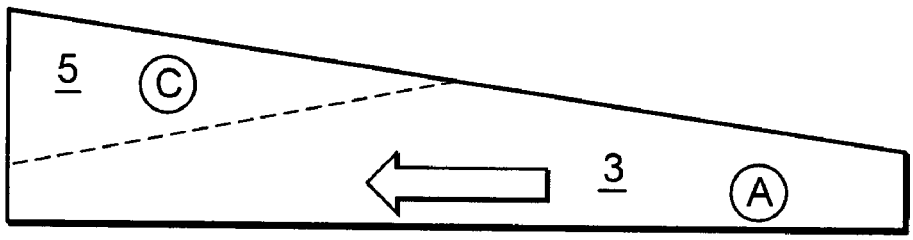
FIG. 2*b* a schematic representation of an arrangement of the bar graphs for visualizing a process variable in a process with tendential decrease.
Figure 2C:
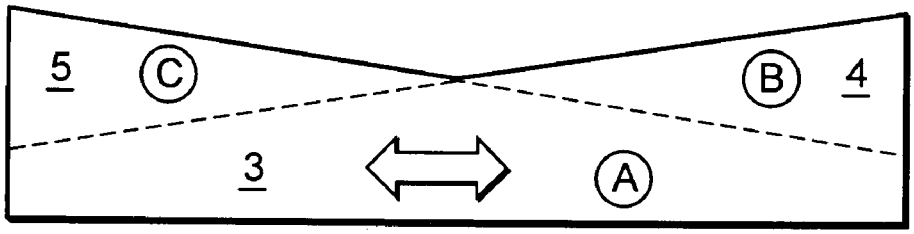
FIG. 2*c* a schematic representation of an arrangement of the bar graphs for visualizing a process variable in a control process.

The particular application case is defined using the input unit 12. Depending on the application case, the control unit assembles the suitable bar graphs 3, 4, 5 mosaic-like in such a manner that they are optimally matched to the particular application case. FIGS. 2*a* to 2*c* show compositions of the bar graphs 3, 4, 5 for different application cases. Thus, FIG. 2*a* is a schematic representation of an arrangement of the bar graphs 3 and 4 for visualizing a process variable in a process with tendential increase, while FIG. 2*b* is a schematic representation of an arrangement of the bar graphs 3, 5 for visualizing a process variable in a process with tendential decrease, and FIG. 2*c* shows a schematic representation of an arrangement of the bar graphs 3, 4, 5 for visualizing a process variable in a control process.

For signaling the sub-, respectively exceeding, of a limit value, arrow-shaped markings 6 are provided in the end regions of the individual bar graphs 3, 4, 5, respectively the individual surface elements A, B, C. Also these markings 6 are composed, preferably, of two display segments. Additionally, e.g. the transition region important for NAMUR can be visualized by the display segment lying between the end region of a bar graph 3; 4; 5, respectively a surface element A; B; C, and the arrow-shaped marking 6. The display segment, which forms the actual arrow tip, represents the error case.

In addition to the bar graphs 3, 4, 5, respectively the belonging surface elements A, B, C, two regions 7, 8 are provided on the display unit 2 for presenting alphanumeric characters. Region 7 serves for reporting the currently measured, process variable in the form of a numerical value. Region 8 is a so-called dot-matrix region. Via region 8, it is possible to confirm, for example, the input, e.g. the application case.

Furthermore, symbols are presented on the display unit 2. For instance, the lock symbol 9 represents, for example, a hardware-based locking of the display unit 2, while the key symbol 10 symbolizes a software-based locking of the display unit 2.

Above the bar graph display, the symbols of control-elements/valves are presented. If the display serves for visualizing the fill level of a fill substance in a container, then it can be indicated, by a lighting of the associated control-element symbol, that the corresponding control element has been actuated.

The invention claimed is:

1. A device for representing and/or displaying various process and/or controlled variables for selectable application cases on a display unit, comprising:

the display unit on which bar graphs are arranged in respective, predetermined surface elements, each bar graph, respectively each surface element has a defined form and/or a defined position on the display; and a control unit which assembles the bar graphs, respectively the corresponding surface elements, mosaic-like in a display or said display unit in such a manner that the resulting bar graph display is matched to a selected application case, wherein:

a first bar graph of said bar graphs, respectively a first surface element (A), has a predetermined length and a predetermined height, said height of said first bar graph, respectively the first surface element (A), differs in a middle region from the height of said first bar graph, respectively the first surface element (A), in its two lateral, end regions;

said first bar graph of said bar graphs, respectively said first surface element (A), is formed point-symmetrically with reference to a perpendicular bisector;

said first bar graph of said bar graphs, respectively said first surface element (A), has a maximum height in a region at the perpendicular bisector and a minimum height in two lateral, end regions;

a second bar graph of said bar graphs, respectively a second surface element (B), and a third bar graph of said bar graphs, respectively a third surface element (C) both are formed as acute-angled, isosceles triangles;

peaks of said isosceles triangles adjoin the region of maximum height of said first bar graph of said bar graphs, respectively said first surface element (A); and bases of said two isosceles triangles lie, respectively, parallel to the perpendicular bisector in said two end regions of said first bar graph, respectively said first surface element (A).

2. The device as claimed in claim 1, further comprising:

an input unit is provided, via which a particular bar graph display is determinable for a selected application case.

3. The device as claimed in claim 1, wherein:

by a combination of said first bar graph and said second bar graph, respectively of said first surface element (A) and said second surface element (B), a bar graph (A+B) rising from a left region of the display to a right region of the display is formed.

4. The device as claimed in claim 1, wherein:

by a combination of said first bar graph and said third bar graph, respectively said first surface element (A) and said third surface element (C), a bar graph (A+C) rising from a right region of the display to a left region of the display is formed.

5. The device as claimed in claim 1, wherein:

by a combination of said first bar graph, said second bar graph and said third bar graph, respectively of said first surface element (A), said second surface element (B) and said third surface element (C), a bar graph (A+B+C) rising from the perpendicular bisector of said first surface element (A) to a left region and to a right region is formed.

6. The device as claimed in claim 3, wherein:

in end regions of said individual bar graphs, respectively said individual surface elements (A, B, C), arrow-shaped markings are provided.

7. The device as claimed in claim 1, wherein:

at least one region is provided on said monitor for representing alphanumeric characters and/or symbols.

* * * * *